US010738391B2

(12) United States Patent
Trenkner

(10) Patent No.: US 10,738,391 B2
(45) Date of Patent: Aug. 11, 2020

(54) TWO-CHAMBER ELECTRODIALYSIS CELL WITH ANION AND CATION EXCHANGE MEMBRANE FOR USE AS AN ANODE IN ALKALINE ZINC ELECTROLYTES AND ZINC ALLOY ELECTROLYTES FOR THE PURPOSE OF DEPOSITION OF METAL IN ELECTROPLATING SYSTEMS

(71) Applicant: COVENTYA INTERNATIONAL GMBH, Gütersloh (DE)

(72) Inventor: Hartmut Trenkner, Elsterwerda (DE)

(73) Assignee: Coventya International GmbH, Gütersloh (DE)

( * ) Notice: Subject to any disclaimer, the term of this patent is extended or adjusted under 35 U.S.C. 154(b) by 0 days.

(21) Appl. No.: 15/553,445

(22) PCT Filed: Mar. 16, 2016

(86) PCT No.: PCT/EP2016/055690

§ 371 (c)(1),
(2) Date: Aug. 24, 2017

(87) PCT Pub. No.: WO2016/150793

PCT Pub. Date: Sep. 29, 2016

(65) Prior Publication Data

US 2018/0087177 A1 Mar. 29, 2018

(30) Foreign Application Priority Data

Mar. 25, 2015 (DE) ..... 20 2015 002 289 U
Jul. 18, 2015 (DE) ..... 10 2015 009 379

(51) Int. Cl.
*C25B 9/06* (2006.01)
*C25B 9/00* (2006.01)
(Continued)

(52) U.S. Cl.
CPC ..... *C25D 21/22* (2013.01); *C25D 3/22* (2013.01); *C25D 3/56* (2013.01); *C25D 3/565* (2013.01);
(Continued)

(58) Field of Classification Search
CPC .... C25B 9/06; C25B 9/00; C25B 9/08; C25B 9/10; C25B 11/00; C25B 9/12;
(Continued)

(56) References Cited

U.S. PATENT DOCUMENTS 5,162,079 A 11/1992 Brown
6,602,394 B1 8/2003 Hillebrand
(Continued)

FOREIGN PATENT DOCUMENTS

| | | | |
|---|---|---|---|
| DE | 40 16 000 | A1 | 11/1991 |
| DE | 690 13 825 | T2 | 5/1995 |
| DE | 198 34 353 | A1 | 2/2003 |
| DE | 10 2010 044551 | A1 | 3/2012 |
| EP | 1 344 850 | A1 | 9/2003 |
| WO | WO 2001/096631 | A1 | 12/2001 |
| WO | WO 2004/108995 | A1 | 12/2004 |

OTHER PUBLICATIONS

European Patent Office, International Search Report issued in International Application No. PCT/EP2016/055690 (dated Sep. 14, 2016).

(Continued)

*Primary Examiner* — Zulmariam Mendez
(74) *Attorney, Agent, or Firm* — Leydig, Voit & Mayer, Ltd.

(57) ABSTRACT

The invention relates to an anode for use in electroplating applications for highly alkaline electroplating electrolytes based on sodium hydroxide for depositing zinc and zinc alloys onto steel substrates and die-cast zinc substrates.

8 Claims, 5 Drawing Sheets

(51) Int. Cl.

| | |
|---|---|
| ***C25B 9/08*** | (2006.01) |
| ***C25B 9/10*** | (2006.01) |
| ***C25B 9/12*** | (2006.01) |
| ***C25D 17/00*** | (2006.01) |
| ***C25D 17/02*** | (2006.01) |
| ***C25D 21/22*** | (2006.01) |
| ***C25D 3/22*** | (2006.01) |
| ***C25D 17/12*** | (2006.01) |
| ***C25D 3/56*** | (2006.01) |
| ***C25D 17/10*** | (2006.01) |

(52) U.S. Cl.
CPC ..... *C25D 17/002* (2013.01); *C25D 17/10* (2013.01); *C25D 17/12* (2013.01)

(58) Field of Classification Search
CPC ..... C25B 9/18; C25B 9/206; C25D 17/10; C25D 5/02; C25D 17/00; C25D 17/002; C25D 17/02
USPC ..... 204/242
See application file for complete search history.

(56) References Cited

U.S. PATENT DOCUMENTS

| | | | |
|---|---|---|---|
| 7,807,035 | B2 | 10/2010 | Hillebrand |
| 8,486,235 | B2 | 7/2013 | Hillebrand |
| 2004/0104123 | A1 | 6/2004 | Hillebrand |
| 2005/0189231 | A1 | 9/2005 | Capper et al. |
| 2008/0164150 | A1 | 7/2008 | Hillebrand |
| 2011/0031127 | A1 | 2/2011 | Hillebrand |

OTHER PUBLICATIONS

European Patent Office, Written Opinion issued in International Application No. PCT/EP2016/055690 (dated Sep. 14, 2016).

International Bureau of WIPO, International Preliminary Report on Patentability in International Application No. PCT/EP2016/055690 (dated Oct. 5, 2017).

European Patent Office, Notification under Article 94(3) EPC in European Patent Application No. 16 711 218.4 (dated Nov. 16, 2018).

TWO-CHAMBER ELECTRODIALYSIS CELL WITH ANION AND CATION EXCHANGE MEMBRANE FOR USE AS AN ANODE IN ALKALINE ZINC ELECTROLYTES AND ZINC ALLOY ELECTROLYTES FOR THE PURPOSE OF DEPOSITION OF METAL IN ELECTROPLATING SYSTEMS

CROSS-REFERENCE TO RELATED APPLICATIONS

This patent application is the U.S. national phase of International Application No. PCT/EP2016/055690, filed on Mar. 16, 2016, which claims the benefit of German Patent Application No. 20 2015 002 289.8, filed Mar. 25, 2015, and German Patent Application No. 10 2015 009 379.7, filed Jul. 18, 2015, the disclosures of which are incorporated herein by reference in their entireties for all purposes.

The invention relates to an anode in a Galvano technical application for use in strongly alkaline, galvanic electrolytes based on sodium hydroxide for the deposition of zinc and zinc alloys on the substrates of steel and zinc die-casting.

Prior art is to use the most common insoluble anodes made of steel, stainless steel or nickel-plated steel in alkaline galvanizing electrolytes. Thereby various geometric shapes are selected, e.g., plates in a rectangular shape, expanded metal in a rectangular or cylindrical shape, round bars, tubes and others.

Strongly alkaline galvanic electrolytes tend towards partially strong deposition on the anode surfaces, depending on the electrolyte composition, after a relatively short operation time of a few weeks. This has the disadvantage of a gradual deterioration of the cathodic current yield and thus the efficiency of the galvanic process as well as the galvanic system. The cost of electrical energy per square meter of coated surface increases gradually.

These deposits are composed of sodium hydroxide-based electrolytes to the large proportion of sodium carbonate and sodium oxalate due to oxidation at the anode surface. In addition, organic degradation products alter the output properties of the galvanic electrolytes. A regular, sometimes high cleaning effort is necessary. The carbonate content of such electrolytes often must be reduced with crystallizers under additional electric energy consumption. Alternatively, the galvanic bath can be replaced or diluted regularly. The used electrolytes are disposed of and generate additional chemical-, disposal- and wastewater-treatment costs as well as system failure time.

It is described in EP 1 344 850 A1 how these mentioned disadvantages can be eliminated or reduced by zinc-nickel alloy coating. The zinc-nickel electrolytes are separated from the anode by a perfluorinated cation exchange membrane. As anolyte, dilute sulfuric acid is used, and as an anode material plated titanium is used.

The designs of such membrane anodes, which are used in the galvanic bath, are usually boxes, wherein the side, which is oriented to the galvanic material, is formed by the cation exchange membrane. As an anode, platinized expanded metal is generally used.

As the disadvantages of the large-scale application of the patent EP 1344850 A1, the following can be mentioned:

a) Dilution of the zinc-nickel electrolytes during the galvanic process due to the neutralization of sodium hydroxide by positively charged hydrogen ions (protons) of the sulfuric acid anolyte, which are "transported" through the cation exchange membrane and react with negatively charged hydroxide ions to form water:

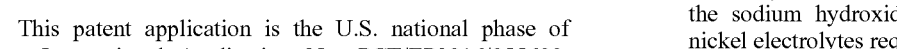

$$H^+_{Anolyte} + OH^-_{Catholyte} \rightarrow H_2O$$

This process goes in one direction and leads to the mentioned permanent, slow dilution of the zinc-nickel electrolytes.

b) Volume increase of the zinc-nickel electrolytes:

The dilution described in point a) and the resulting necessary addition of sodium hydroxide to restore the sodium hydroxide concentration in the zinc-nickel electrolytes required for alloy deposition contribute to the volume increase of the electrolyte, when the ionic activity of the zinc-nickel electrolytes is greater than that of the sulfuric acid anolyte. Osmotic pressure rises and additional water is pressed through the cation-exchange membrane to the zinc-nickel electrolyte. This results in an additional dilution and volume increase of the zinc-nickel electrolytes.

c) Following a) and b), an additional considerable technical and energy expenditure are required, in order to concentrate the permanently developing, slightly dilute electrolyte volume increase by means of a vacuum evaporator and to restore it discontinuously in the zinc-nickel electrolytes.

In WO 2001/096631 A1 and WO 2004/108995 A1, as anolyte, instead of sulfuric acid a sodium hydroxide solution is used, which offers the advantage that no hydrogen ion (protons) reaches to the described zinc-nickel electrolytes from the anolyte through the cation exchange membrane, and this can be diluted by reaction with hydroxide ions to water or converted to dangerous hydrogen cyanide in the presence of cyanide ions in the zinc-nickel electrolytes, when passing through the membrane.

As the disadvantage of the use of sodium hydroxide solution as anolyte, however the continuously increasing concentration of sodium hydroxide and the permanent volume increase of the zinc-nickel electrolytes must be considered, because sodium ions as positive charge carriers migrate from the anolyte to the cathode through the cation exchange membrane, and increase the sodium hydroxide concentration with the "free" hydroxide ions of the water fission as a co-reaction of the metal deposition at the cathode.

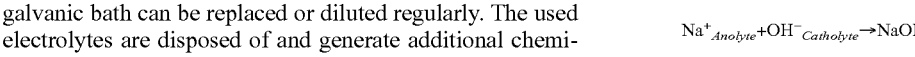

$$Na^+_{Anolyte} + OH^-_{Catholyte} \rightarrow NaOH$$

This effect leads to a growing concentration difference between the anolyte and the zinc-nickel electrolytes, meaning that the anolyte concentration decreases and the zinc-nickel electrolyte concentration increases. Subsequently, osmosis is applied from the anolyte to the catholyte through the cation exchange membrane, by which water is withdrawn from the anolyte and moves to the zinc-nickel electrolytes. This fact leads now to the mentioned continuous increase of the zinc-nickel electrolyte volume and the decrease of the anolyte volume. In a large-scale application, this means that measures are to be taken for the disposal of the zinc-nickel-electrolyte-volume surplus as well as the dilution of the zinc-nickel electrolyte during certain time intervals, which has a negative effect on the procedure costs.

Starting from the described disadvantages of the use of membrane anodes with cation exchange membranes in galvanic electrolytes, the present invention is based on the problem, such as establishing an electro-dialysis cell and making the galvanic zinc and zinc alloy device available for industrial application that does not have the disadvantages explained in the preceding text any more when performing the process,

- An increase in the concentration of sodium hydroxide in the zinc- or zinc alloy electrolytes
- An increase in volume of the zinc- or zinc alloy electrolytes
- Salt deposits on the anode surface or the ion exchange membrane
- Volume-loss of the anolyte by osmosis and of which the production costs are moving within the scope of electro-dialysis cells with cation exchange membranes of the prior art.

The advantages of using a membrane anode with cation exchange membranes, as described in the cited patents, are described in the application of the invention herein.

The invention is based on comprehensive laboratory investigations, of which the results form the basis for the description of the structural design and function of the two chamber electro-dialysis cell.

The described problems are solved with the features described herein.

The invention relates to a two chamber electro-dialysis cell with an anion- and a cation exchange membrane for use as an anode in alkaline zinc- and zinc alloy electrolytes for the purpose of metal deposition in galvanic systems.

In the Galvano-technical application of electro-dialysis cells with an anolyte chamber, where the anode is separated from the strongly alkaline, amine-containing zinc-nickel electrolytes and the cathode (galvanic material) through a cation exchange membrane, in order to avoid anodic oxidation of the organic electrolyte additives and a fall of the cathodic current yield upon the application of galvanic current, the positively charged ions (sodium ions, patent WO2001096631 A1) or protons (patent DE19834353 A1) are "transported" from the anolyte chamber to the zinc-nickel electrodes. This leads to irreversible changes in concentration and volume of the zinc-nickel electrolytes and consequently has the additional costs for chemicals and disposal.

By using the two chamber electro-dialysis cell, these disadvantages are eliminated.

The function of the two chamber electro-dialysis cell prevents an increase of the sodium hydroxide concentration and the volume of the zinc-nickel electrolytes.

It consists of an inner-(6) and an outer anolyte chamber (5). The inner chamber with the anode (7) is separated from the outer chamber by a cation exchange membrane (4). This, in turn, is separated from the zinc-nickel electrolytes by an anion-exchange membrane (3). The inner anolyte chamber is connected to an anolyte circuit via valves (1) and (2). By the anodic reaction, the sodium hydroxide concentration in the anolyte circulation system decreases. The sodium hydroxide concentration in the outer chamber increases to the value of 300 g/l as a result of the "ion migration" of $Na^{+}_{anolyte}$ and $OH^{-}_{zinc\ nickel}$. Osmosis deprives the zinc-nickel electrolyte of water through the anion exchange membrane.

Due to the osmotic pressure, the sodium hydroxide volume in the outer chamber increases, and can be returned to the anolyte circuit through the valve (10) with a hose (11) or zinc-nickel electrolytes. The concentrations and volumes of the anolyte and the zinc-nickel electrolytes can thus be kept stable.

The two chamber electro-dialysis cell is preferably suitable for use in strongly alkaline, galvanic zinc-nickel electrolytes, which are constructed based on sodium hydroxide and amine-containing additives, because here the efficiency of the deposition process is particularly strongly positively influenced.

The cathodic current yield remains at a high level. Process reliability is increased. No additional disposal costs are required. Process chemicals are saved.

BRIEF DESCRIPTION OF THE DRAWINGS

An advantageous embodiment of the invention is illustrated in FIGS. 1, 2 and 3, and is taken as a basis for the further description. Other designs, described herein and graphically illustrated in FIG. 5, are technically possible.

It shows.

DETAILED DESCRIPTION OF THE INVENTION

Figure 1:
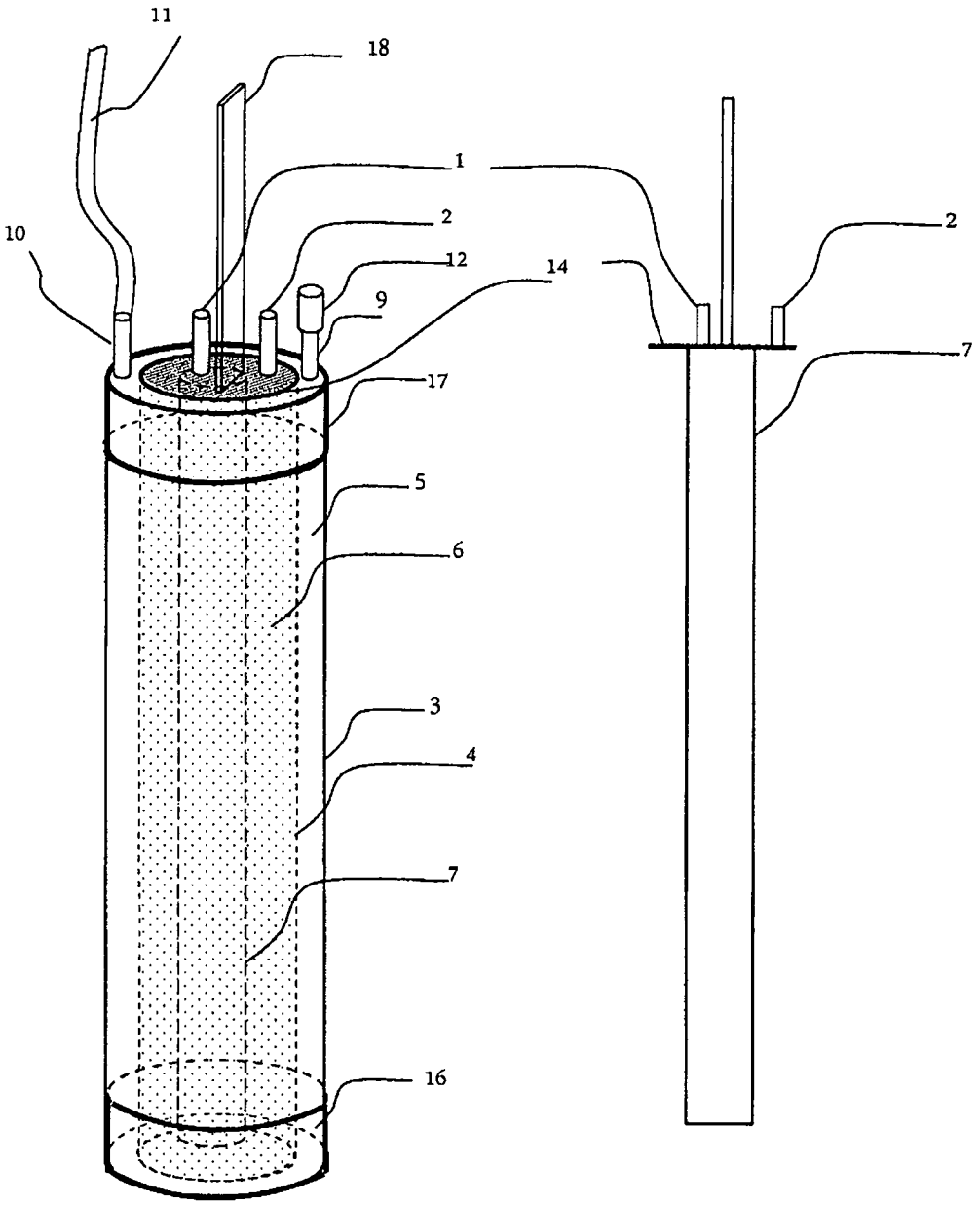
FIG. 1 the principle structure of the electro-dialysis cell with the function-relevant components, FIG. 2 the detailed illustration of the structure of a cylindrical electro-dialysis cell, FIG. 3 the arrangement of the ion exchange membranes and the anode tube in a cross-section, FIG. 4 the technical construction diagram of a galvanic bath with the electro-dialysis cells and the necessary technical peripherals, FIG. 5 the graphical illustration of a possible box construction design.
Figure 2:
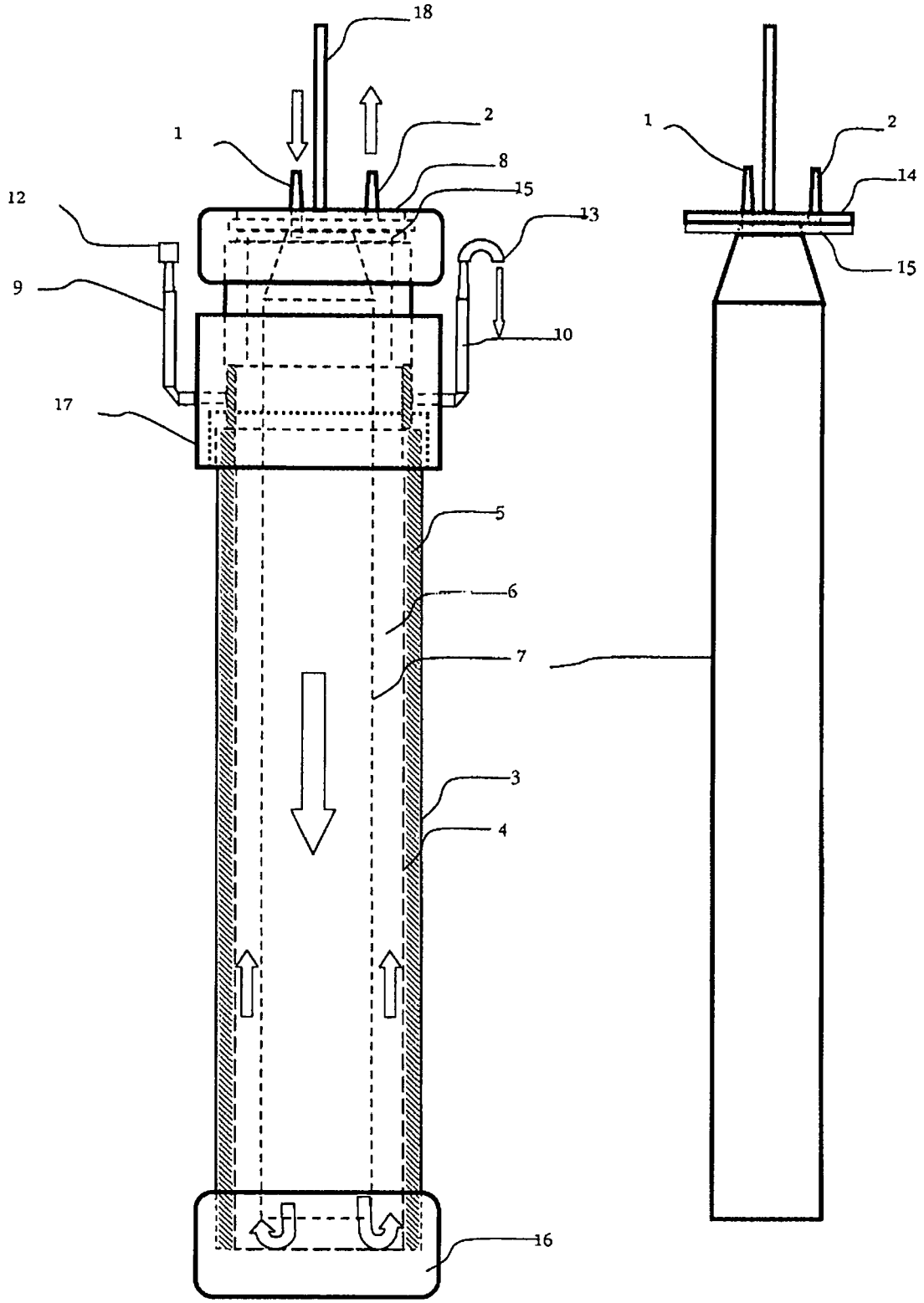
Figure 3:
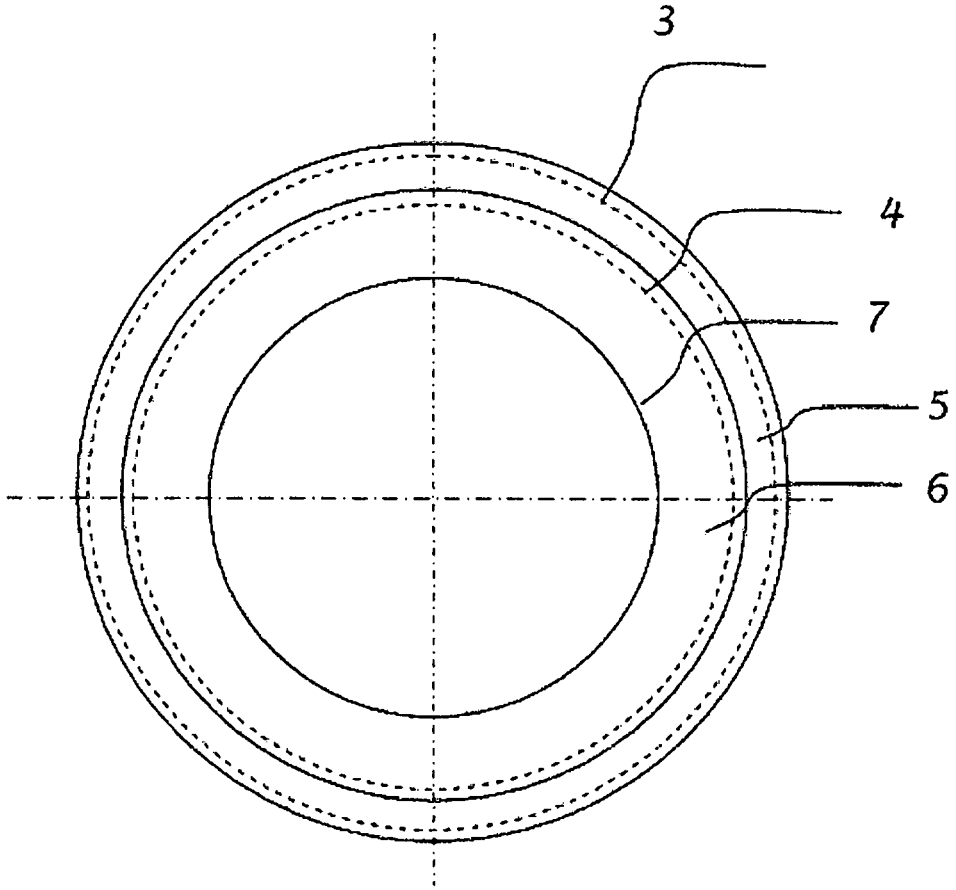

As described herein, instead of an ion exchange membrane, two ion exchange membranes are used to form a solid electro-dialysis module, as shown in FIGS. 1 and 2, so that the two anolyte chambers (5) and (6) are built.

The electro-dialysis module is composed of two structural components screwed together:

a) anode (7) with a screw cap (8), FIGS. 1 and 2 b) plastic body

The anode may be made of a stainless steel tube (7), of which diameter and length can be different depending on the application and which is tapered on one side, and a circular stainless steel plate (14), which is firmly connected to the anode tube (e.g., welded). A common tube diameter for the application would be e.g. 2 inches. Two holes of different diameters in the plate serve for screwing or welding the inlet- and outlet valve (1) and (2) for the anolyte sodium hydroxide (concentration approx. 160 g/l), referred to as "anolyte 1" in the further description. The inlet- and outlet valve can be hose nozzles of different diameters, wherein the smaller diameter is to be used for the inlet, in order to prevent additional hydrostatic pressure inside the electro-dialysis cell during the flowing of the anolyte 1. Furthermore, the suspension device (18) is firmly connected to the plate, which simultaneously serves for the current transmission from the anode to the electro-dialysis cell.

The plastic body consists of a plastic-foot cap, e.g. PVC (16), into which a plastic grid tube piece, e.g. polypropylene, of a defined length, e.g. 700 mm and a defined diameter, e.g. 80 mm with thereon lying cation exchange membrane (4) as well as a second grid tube piece of a defined length, e.g. 640 mm and diameter, e.g. 100 mm with thereon lying anion exchange membrane (3) are hermetically sealed, e.g. pouring in resin. The upper part of the two-chamber cylinder is also hermetically sealed in a plastic collar (17), so that both chambers have no connection to one another. The tubular plastic collar (17) has an external thread at the upper end, e.g. 2½". The anode (7) is inserted into the plastic body. A flat gasket ring (15) is located under the plate. With a plastic screw cap (8), which has an opening at the top of which diameter must be approximately 10 mm smaller than the diameter of the plate (14) and has an internal thread, e.g. 2½", the anode is screwed with the plastic body.

In the plastic collar, there are two opposite thread holes, the passage to the outer anolyte chamber. These are used for the screwing of two valves (9) and (10), e.g. angled thread valves with hose nozzles. Through one of these two valves, the outer anolyte chamber (5) is filled with sodium hydroxide (concentration, e.g., 160 g/l), referred to as "anolyte 2" in the further description, while venting takes place via the other valve. Thereafter, one of the two nozzles is provided with a cover cap (12), in order to prevent the later penetration of zinc-/zinc alloy electrolytes into the anolyte 2 during the production process. The outlet valve (10) for the overflowing anolyte 2 in the working condition of the electro-dialysis cell is provided with a hose (11) or a plastic tube arch (13) with an opening pointing downwards for the same reason.

With the invention, it is achieved, when the current is flowing in the galvanic bath, the positively charged sodium ions released at the anode pass from the inner anolyte chamber (6) through the cation exchange membrane (4) into the outer anolyte chamber (5), and there a further "transport" into the zinc- or zinc alloy electrolytes are blocked by the anion exchange membrane (3). In return, equivalent amount of charges of negatively charged hydroxide ions "migrate" from the zinc- or zinc alloy electrolyte in the direction of the anode (7), and pass the anion exchange membrane (3) into the outer anolyte chamber (5) of the electro-dialysis cell. Here, they are prevented from being further transported to the anode through the cation exchange membrane (4).

As a result of the electrochemical metal deposition process, the sodium hydroxide concentration continuously rises in the outer anolyte chamber (5), and osmosis is set to counteract the increase of the concentration gradient between the outer anolyte chamber and the zinc/zinc alloy electrolytes. Thereby, water is drawn from the zinc-/zinc alloy electrolytes through the anion exchange membrane (3) and reaches the outer anolyte chamber (5). The volume of the anolyte 2 in the outer anolyte chamber thus increases continuously. The volume surplus is removed from the electro-dialysis cell via the outlet device (10). In practical application, the excess amount of sodium hydroxide solution (anolyte 2) should be recycled to 50% each in the zinc-/zinc alloy electrolyte and the anolyte 1, in order to maintain the concentration and volume ratios of zinc-/zinc alloy electrolyte and anolyte 1 approximately constant, because the charge carriers, sodium ions and hydroxide ions reach into the anolyte 2 chamber (5) from the anolyte 1 and the zinc-/zinc alloy electrolytes in an equivalent quantity.

Figure 4:
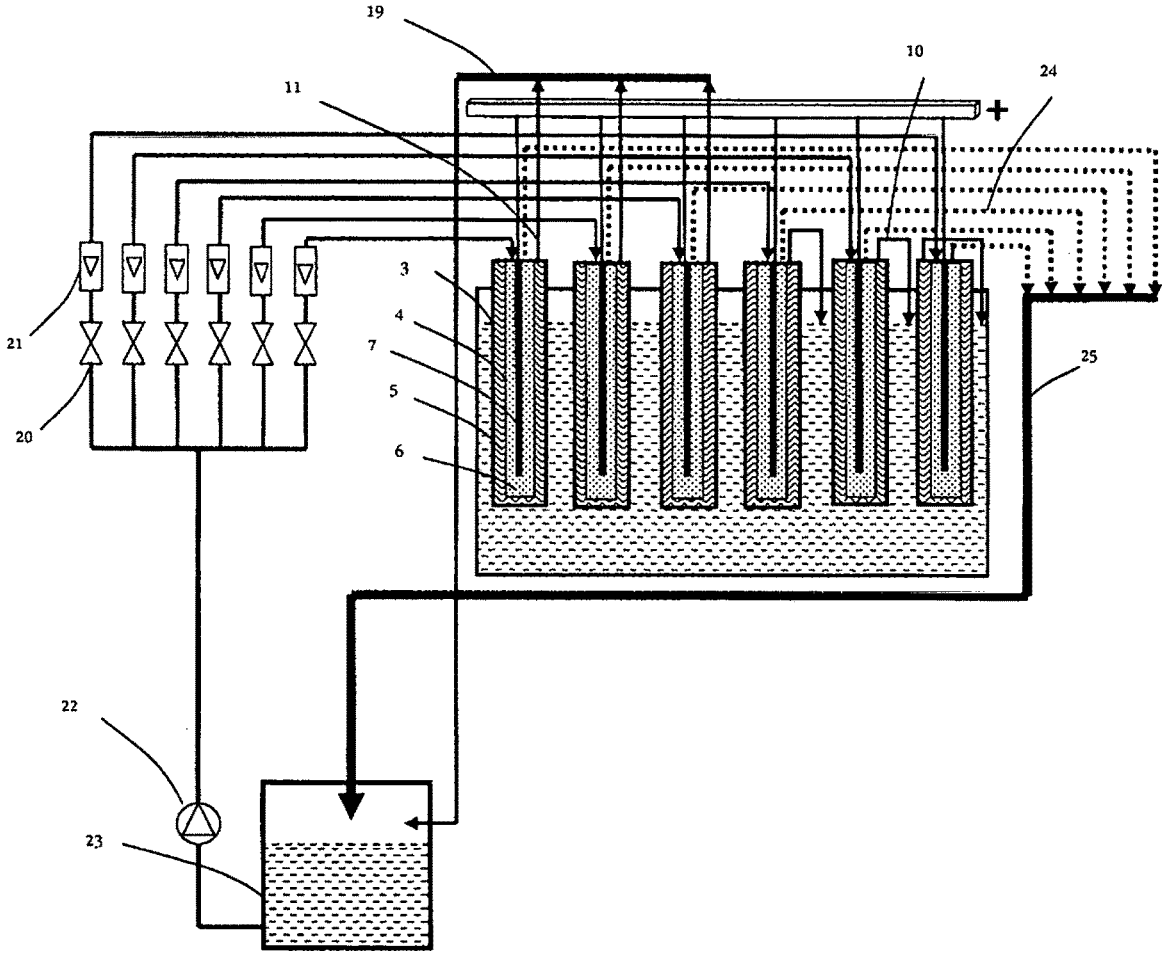
Figure 5:
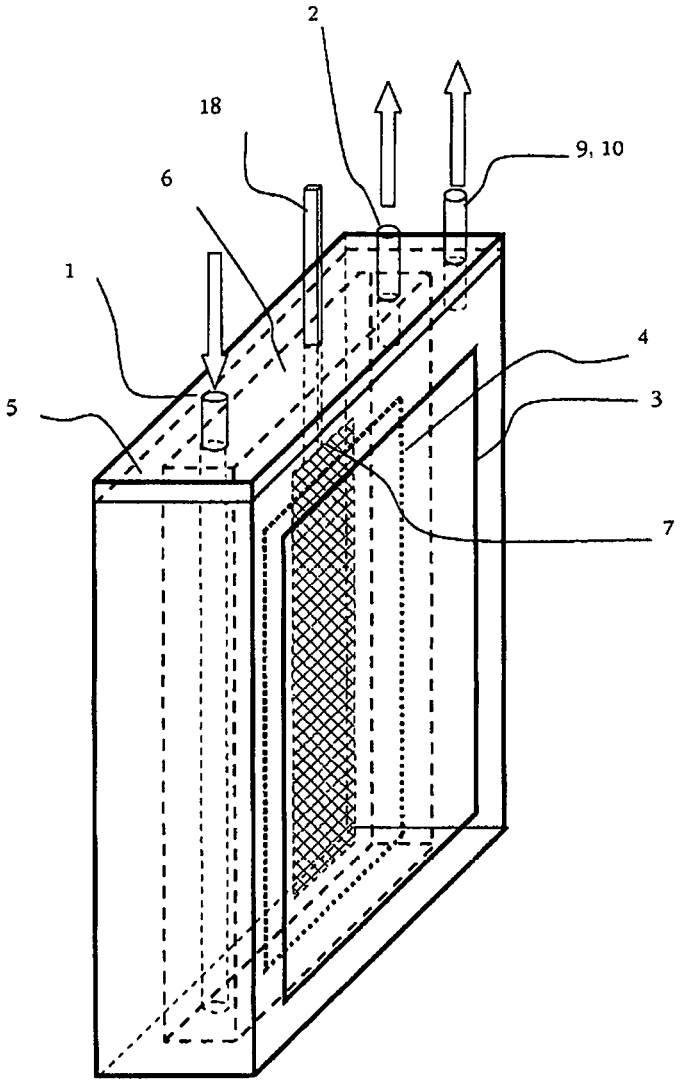

The supply of the anolyte 1 that is required for electrochemical oxidation at the anode with a recommended concentration of approx. 160 g/l of sodium hydroxide takes place, as shown in FIG. 4, in the circulation system by means of a circulating pump (22) from a storage reservoir (23) via stop-valves (20) and flow measuring meter (21) to each individual electro-dialysis cell.

The discharge of the anolyte 1 from the electro-dialysis cells must be carried out without an additional counter pressure in the anolyte 1 reservoirs (23), in order not to over-extend the ion exchange membranes, which can result in microcracks and leakages. A practical way of realization is the connection of the return hoses of anolyte 1 in the free outlet according to FIG. 4, (24) into a central return line, FIG. 4, (25), of suitably large capacity and slight slope to the anolyte 1 supply reservoir.

In FIG. 2, the anolyte flow of anolyte 1 through the electro-dialysis cell is illustrated for better understanding with arrows.

The outlet of the surplus volume of anolyte 2 into the zinc-/Zinc alloy electrolytes is very easily carried out by passing it freely through the valve with a nozzle (10) and tube arch (13), (see FIG. 2), in the half of the number of electro-dialysis cells located in the galvanic system. The outlet of the overflowing anolyte 2 volume into the anolyte 1 storage reservoir occurs, by the other half of the number of the electro-dialysis cells located in the galvanic system, through the valve with a nozzle (10), in which a plastic tube (11) is inserted, which opens into a central return line to the anolyte 1 reservoir, see FIG. 4, (19).

To ensure a reliable function of the described invention, the following basic chemical requirements must be met, which is to be ensured by regular analysis:

The concentration of sodium hydroxide of the anolyte 1 should always be approx. 30 g/l greater than the sodium hydroxide concentration of the zinc-/zinc alloy electrolytes. However, it must be smaller than the sodium hydroxide concentration of the anolyte 2. Only then, it is possible that the osmotic water is "pushed" mainly from the zinc-/zinc alloy electrolytes into the anolyte 2 chamber of the electro-dialysis cell by osmotic pressure through the anion exchanger membrane.

The initial concentrations of sodium hydroxide of the anolyte 1 and 2 can be the same before the start-up of the electro-dialysis cells, as shown in the reference list below (5), (6), because the concentration of anolyte 2 increases after the application of the galvanic current with the running of operation time and the concentration of anolyte 1 decreases.

With the application of the described invention, the following effects can be achieved:

1. Saving of process chemicals, because an oxidative conversion, in particular, of organic additions such as brightening additive solutions and complexing agents at the anode, is prevented.
2. Significantly less sodium carbonate formation in zinc-/zinc alloy electrolytes.
3. An increase of cathodic current yield.
4. An increase of the throughput in the galvanic system.
5. Saving of the electrical energy per square meter of galvanized surface.
6. Regeneration of old electrolytes, since no new degradation products are formed by anodic oxidation, and the existing ones are gradually removed with the coated product.
7. Saving of additional equipment for the evaporation of volume-surplus, e.g. Vacuum evaporator.
8. Saving of disposal costs for volume-surplus of zinc-/zinc alloy electrolytes.

LIST OF REFERENCE NUMBER

FIGS. 1, 2, 3, 4, 5

1 Inlet valve for anolyte 1
2 Outlet valve for anolyte 1
3 Grid tube/plastic grid with anion exchange membrane
4 Grid tube/plastic grid with cation exchange membrane
5 Outer anolyte chamber with anolyte 2 (sodium hydroxide, initial concentration 160 g/l)
6 Inner anolyte chamber with anolyte 1 (sodium hydroxide, initial concentration 160 g/l)
7 Anode (tube)
8 Plastic screw cap with internal threads

9 Valve with inlet-/outlet nozzles for anolyte 2 (sodium hydroxide, initial concentration 160 g/l)
10 Valve with inlet-/outlet nozzles for anolyte 2 (sodium hydroxide, initial concentration 160 g/l)
11 Outlet hose for anolyte 2 to the central return line to the anolyte 1 storage reservoir
12 Cap for outlet nozzle of anolyte 2
13 Tube arch for outlet nozzle of anolyte 2
14 Welded plate on anode tube with inlet and outlet nozzle for anolyte 1
15 Gasket
16 plastic foot cap
17 plastic collar
18 suspension- and power supply
19 Central return line of anolyte 2 to the storage reservoir of anolyte 1
20 Stop valve in the inlet line of anolyte 1
21 flow measuring meter
22 Circulating pump for anolyte 1
23 Reservoir for anolyte 1
24 Return line of anolyte 1 from the electro-dialysis cell to a central return line
25 Central return line into the anolyte 1 storage reservoir

The invention claimed is:

1. A two-chamber anodic system which is suitable for utilizing in a galvanic system comprising the two-chamber anode system and a cathode, the two-chamber anodic system containing an anodic substrate in combination with an alkaline zinc- or zinc alloy electrolyte for the deposition of zinc- or zinc alloy, wherein:

the anodic substrate is separated from the alkaline zinc- or zinc alloy electrolyte by a cation- and an anion exchange membrane;

the cation and anion exchange membranes form two separate anolyte chambers which are inner anolyte chamber and outer anolyte chamber;

the inner anolyte chamber, where the anodic substrate is located, is flowable through by an anolyte; wherein the inner anolyte chamber has an inflow device through which the anolyte flow is directed to a foot of the anodic substrate; and the outer anolyte chamber has openings with inflow- and outflow devices to be filled with the anolyte;

wherein the outer anolyte chamber surrounds the inner anolyte chamber;

wherein the inner anolyte chamber and the outer anolyte chamber each has an inflow device and an outflow device; and wherein the inner anolyte chamber has an outlet flow device through which the ascending anolyte flow is conveyed into an outlet line, which opens into an anolyte reservoir, in a collecting line.

2. The two-chamber anodic system according to claim 1, wherein the cation exchange membrane is placed towards the anodic substrate and the anion exchange membrane is placed towards the cathode.

3. The two-chamber anodic system according to claim 1, wherein the inner anolyte is sodium hydroxide or potassium hydroxide.

4. The two-chamber anodic system according to claim 1, wherein outer anolyte is sodium hydroxide or potassium hydroxide.

5. The two-chamber anodic system according to claim 1, wherein the anodic substrate is steel, stainless steel, nickel or nickel-plated steel.

6. The two-chamber anodic system according to claim 1, which is constructed in different geometric shapes.

7. The two-chamber anodic system according to claim 6, which is constructed in a box-type design.

8. The two-chamber anodic system according to claim 1, wherein the outer anolyte chamber is retrofittable with an anion exchange membrane.

* * * * *